US007806947B2

(12) United States Patent
Gunnerman et al.

(10) Patent No.: US 7,806,947 B2
(45) Date of Patent: Oct. 5, 2010

(54) LIQUID HYDROCARBON FUEL FROM METHANE ASSISTED BY SPONTANEOUSLY GENERATED VOLTAGE

(76) Inventors: Rudolf W. Gunnerman, 6601 Windy Hill Way, Reno, NV (US) 89511; Peter W. Gunnerman, 2630 Lakeridge Shores West, Reno, NV (US) 89519

( * ) Notice: Subject to any disclaimer, the term of this patent is extended or adjusted under 35 U.S.C. 154(b) by 0 days.

(21) Appl. No.: 12/551,264

(22) Filed: Aug. 31, 2009

(65) Prior Publication Data

US 2010/0140135 A1 Jun. 10, 2010

(51) Int. Cl.
*C01B 3/24* (2006.01)

(52) U.S. Cl. ..... 48/198.1

(58) Field of Classification Search ..... 48/198.1; 208/15

See application file for complete search history.

(56) References Cited

U.S. PATENT DOCUMENTS 6,593,377 B1 * 7/2003 Harford et al. ..... 518/706
7,642,292 B2 * 1/2010 Severinsky ..... 518/700

* cited by examiner

*Primary Examiner*—Jafar Parsa
(74) *Attorney, Agent, or Firm*—Townsend and Townsend and Crew LLP; M. Henry Heines

(57) ABSTRACT

A methane-containing gas such as natural gas is converted to a clean-burning hydrocarbon liquid fuel in a process wherein the gas is fed to a reaction vessel to contact a metallic catalyst grid that is formed from windings of a transition metal supported on an iron frame immersed in a liquid petroleum fraction, in such a manner that a voltage is generated in the grid between the windings and the frame. Product gas in the vapor phase is drawn from the head space above the liquid level and condensed to form the product fuel.

14 Claims, 2 Drawing Sheets

LIQUID HYDROCARBON FUEL FROM METHANE ASSISTED BY SPONTANEOUSLY GENERATED VOLTAGE

BACKGROUND OF THE INVENTION

1. Field of the Invention

This invention resides in the field of petroleum-derived liquid fuels and particularly in the conversion of methane to liquid hydrocarbons.

2. Description of the Prior Art

Alternative sources of automotive fuel are in ever increasing demand as crude oil fluctuates in price and as governments and the public at large become increasingly concerned over the gaseous and particulate emissions that the processing of crude oil releases into the atmosphere. Natural gas is an abundant resource in many parts of the world that do not have native supplies of crude oil and in many cases, the cost of extracting natural gas from its natural reservoirs is significantly lower than that of extracting crude oil. For a variety of reasons, however, including its special requirements for transport and storage, natural gas does not offer the full range of uses that are offered by liquid fuels.

This invention provides a means of converting natural gas, and methane-containing gases in general, to a liquid fuel. In addition, the invention can result in the production of a liquid fuel of surprisingly efficient energy output and versatility.

SUMMARY OF THE INVENTION

It has now been discovered that a fluctuating electric potential can be generated in a reaction vessel by passing a methane-containing gas across a catalytic metallic grid that is immersed in a liquid petroleum fraction, and that the potential thus generated contributes to a chemical reaction between the methane and the liquid petroleum fraction to produce an unusually high-performing liquid fuel. The electric potential is spontaneously generated, without being initiated or supplemented by an externally imposed potential, and can be detected between sites on the metallic grid. Notably, for a grid that consists of windings of a conductive metal or combination of conductive metals, such as two or more transition metals and preferably also aluminum, over an iron frame, the electric potential can be measured between the windings and the iron frame. The fluctuations of the potential are generally irregular in both amplitude and frequency, but with a time-averaged value that significantly exceeds, by at least a factor of ten, the value of any such potential that exists between the same sites on the immersed catalyst grid in the absence of the gas flow through the grid.

The liquid fuel produced by the catalytic reaction between the methane-containing gas and the liquid petroleum fraction is recovered by condensing the gaseous effluent collected from the reaction medium, and it has further been discovered that the product fuel is both clean-burning and highly efficient. When used as an automotive fuel, the fuel produced by this invention produces a mileage that significantly exceeds that of conventional fuels, including that of the liquid petroleum fraction used as the reaction medium. Thus, for example, when the liquid petroleum fraction is diesel oil, the product fuel produces approximately 30% or more miles per gallon, or other equivalent measure of fuel efficiency, than the starting diesel oil. Furthermore, the rate at which the product fuel is produced far exceeds any rate of depletion of the liquid reaction medium.

These and other objects, advantages, and features of the invention are better understood by the description that follows.

DETAILED DESCRIPTION OF THE INVENTION AND PREFERRED EMBODIMENTS

Figure 1:
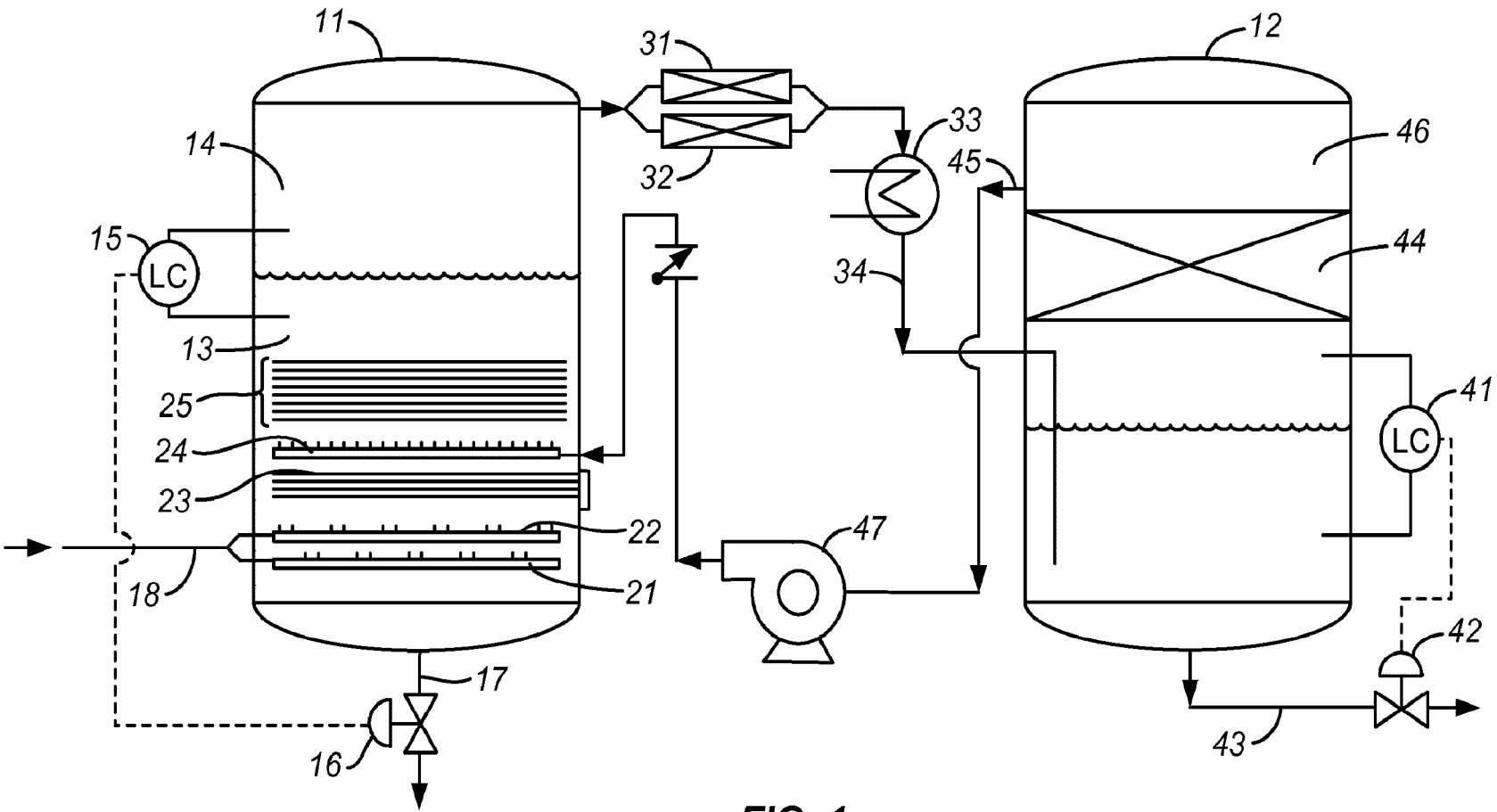
FIG. 1 is a process flow diagram embodying an example of an implementation of the invention.

The methane-containing gas used in the practice of the present invention is preferably a gas in which methane constitutes the major component. Examples are naturally occurring gas as well as industrial gases, and specific examples are coal bed methane, coal mine methane, abandoned mine methane, refinery gas, associated gas, digester gas, and natural gas. Gases containing about 70% or more methane by volume are preferred, more preferably about 85% or more by volume, and most preferably about 93% or more by volume. Natural gas containing about 95% methane by volume is particularly preferred. Natural gas when used is preferably used without supplementation with other gases, and particularly without significant amounts of hydrogen or carbon monoxide, and notably less than 1% by volume of each.

Petroleum fractions for use as the liquid reaction medium in this invention include fossil fuels, crude oil fractions, and many of the components derived from these sources. Fossil fuels, as is known in the art, are carbonaceous liquids derived from petroleum, coal, and other naturally occurring materials, and also include process fuels such as gas oils and products of fluid catalytic cracking units, hydrocracking units, thermal cracking units, and cokers. Included among these carbonaceous liquids are automotive fuels such as gasoline, diesel fuel, jet fuel, and rocket fuel, as well as petroleum residuum-based fuel oils including bunker fuels and residual fuels. The term "diesel fuel" denotes fractions or products in the diesel range, such as straight-run diesel fuel, feed-rack diesel fuel (diesel fuel that is commercially available to consumers at gasoline stations), light cycle oil, and blends of straight-run diesel and light cycle oil. The term "crude oil fractions" includes any of the various refinery products produced from crude oil, either by atmospheric distillation or by vacuum distillation, as well as fractions that have been treated by hydrocracking, catalytic cracking, thermal cracking, or coking, and those that have been desulfurized. Examples of crude oil fractions other than diesel oils are light straight-run naphtha, heavy straight-run naphtha, light steam-cracked naphtha, light thermally cracked naphtha, light catalytically cracked naphtha, heavy thermally cracked naphtha, reformed naphtha, alkylated naphtha, kerosene, hydrotreated kerosene, gasoline and light straight-run gasoline, atmospheric gas oil, light vacuum gas oil, heavy vacuum gas oil, residuum, vacuum residuum, light coker gasoline, coker distillate, FCC (fluid catalytic cracker) cycle oil, and FCC slurry oil. Preferred liquids for the reaction medium are mineral oil, diesel oil, naphtha, kerosene, gas oil, and gasoline. More preferred are diesel oil, kerosene, and gasoline, and the most preferred are kerosene and diesel oil.

The transition metal catalyst can be a single transition metal or a combination of transition metals, either as metal salts, pure metals, or metal alloys, and can also be used in combination with metals other than transition metals. Preferred catalysts for use in this invention are metals and metal alloys. Transition metals having atomic numbers ranging from 23 to 79 are preferred, and those with atomic numbers ranging from 24 to 74 are more preferred. Cobalt, nickel, tungsten, particularly in combination, are the most preferred. An example of an additional metal that can be included is aluminum.

The transition metal(s), together with other metals such as aluminum when included, are formed as windings supported on an iron frame. The catalyst is thus configured as a fixed bed secured to the interior of the reaction vessel. A variety of forms of iron can be used as the frame material. Examples are pig iron, gray iron, and ductile iron. The metal windings can be supported on the iron frame in the form of an open-mesh network, and the windings are preferably supported on the frame by being wound around pegs affixed to the frame, where the pegs are formed of a material that has an electrical resistivity that is substantially higher than the electrical resistivities of both the windings and of the frame. In preferred embodiments, the electrical resistivity of the pegs is at least about $15\times10^{-8}$ ohm meters at 100° C. Chromium and chromium alloys are examples of materials that meet this description.

The electric potential produced in the reactor can be detected between the windings and the iron frame. The potential will vary with the distance between the site on the windings and the site on the frame between which the electrical contacts is measured, and in some cases, with the locations of the sites themselves. In general, the greater the distance, the larger the potential. When the frame is circular in outer diameter with reinforcing bars or rods within the perimeter and the windings converge at the center of the frame, the electric potential is most effectively measured between the windings at the center and the frame itself at a location that is at a radial distance from the center, for example a distance equal to approximately half the radius of the frame. With gas feed rates to the reactor of 50 standard cubic feet per hour (SCFH) or greater, the electric potential between these points will be at least about 100 mV, preferably from about 100 mV to about 10V, most preferably with a time-averaged value of from about 300 mV to about 3V, and mean fluctuation frequencies of from about 30 Hz to about 300 Hz. With gas feed rates within the range of about 10,000 cubic feet per hour to about 100,000 cubic feet per hour, the time-averaged electric potential between these points can be from about 100 mV to about 200 mV, the maximum values can be from about 1V to about 5V, and the frequency can be from about 50 $sec^{-1}$ to about 1,000 $sec^{-1}$.

Contact between the methane-containing gas and the liquid petroleum fraction is achieved by conventional gas-liquid contacting methods. A particularly convenient means of contact as presently contemplated is by bubbling the gas through an otherwise static body of liquid in a tank-form reaction vessel and drawing product vapor from a head space above the liquid level in the reactor. The gas is preferably supplied through one or more gas distributors immersed below the liquid level. Preferred distributors have a wheel-and-spokes configuration or a grid configuration, the wheel or grid being constructed from hollow pipes with an array of apertures that release the gas in the form of small bubbles into the liquid. The apertures, and if desired for ease of construction, the pipes as well, can be covered with a mesh material to further reduce the sizes of the gas bubbles and to further disperse them as they proceed through the reaction medium. The mesh material can be manufactured of any of the metals used as catalyst. Alternatively, an inert material such as a ceramic in the form of a conventional column packing material, can be used.

The reaction is performed under non-boiling conditions to maintain the liquid petroleum fraction that is used as the reaction medium in a liquid state and to prevent or at least minimize the vaporization of the liquid and its escape in unreacted form from the reaction vessel with the product. An elevated temperature, i.e., a temperature above ambient temperature, is used, preferably one that is about 80° C. or above, more preferably one within the range of about 100° C. to about 250° C., most preferably within the range of about 100° C. to about 150° C. The operating pressure can vary as well, and can be either atmospheric, below atmospheric, or above atmospheric. The process is readily and most conveniently performed at either atmospheric pressure or a pressure moderately above atmospheric. Preferred operating pressures are those within the range of about 1 atmosphere to about 2 atmospheres, most preferably within the range of about atmosphere to about 1.5 atmospheres.

A process flow diagram representing one example of a plant design for implementation of the present invention is presented in FIG. 1. The plant includes a reaction vessel 11 and a product vessel 12, each of which is a closed cylindrical tank. The reaction vessel 11 is charged with a petroleum fraction used as a liquid reaction medium 13 leaving a gaseous head space 14 above the liquid. The liquid level is maintained by a level control 15 which is actuated by a pair of float valves inside the vessel. The level control 15 governs a motor valve 16 on a drain line 17 at the base of the vessel.

Natural gas or other methane-containing gas is fed to the reaction vessel 11 underneath the liquid level at an inlet gas pressure of from about 5 psig to about 20 psig, through a gas inlet line 18 which is divided among two gas distributors 21, 22 inside the reactor vessel. Each distributor spans the full cross section of the vessel in either a grid configuration, a wheel-and-spokes configuration, or any other configuration that will support an array of outlet ports distributed across the cross section of the vessel. Two distributors are shown in the Figure, but the number can vary. The optimal number of distributors and outlet ports and the optimal configuration for any individual distributor will be readily determinable by routine experimentation. A single distributor or three or more distributors may thus be optimal for reactor vessels of different capacities. A resistance heater 23 is positioned in the reactor above the gas distributors, and a third gas distributor 24 is positioned above the resistance heater. The third gas distributor 24 receives return gas from the product receiving vessel 12 as explained below.

Positioned above the three gas distributors 21, 22, 24 and the resistance heater 23 but still beneath the liquid level are a series of catalyst grids 25 arranged in a stack. Each grid is a circular ring or apertured plate with metallic catalyst wires strung across the ring and supported by pegs affixed to the ring along the ring periphery. The sizes of the wires and the total length of each wire will be selected to achieve the maximal surface area exposed to the reaction medium while allowing gas to bubble through the grids. The selection of these parameters for optimal results will be readily apparent to anyone skilled in the use of metallic or other solid-phase catalysts in a liquid-phase or gas-phase reaction, or will be a matter of routine experimentation. With wires that are 1 mm in diameter, for example, and with individual wires of each of four metals, such as for example cobalt, nickel, aluminum, and tungsten, two pounds of each metal wire can be used per ring, or eight pounds total per ring. The number of rings can vary, and will in most cases be limited only by the size of the reactor, the gas flow rate into the reactor, the desirability of maintaining little or minimal pressure drop across the rings, and economic factors such as the cost of materials. In a preferred embodiment, seven rings are used, each wound with the same number and weight of wires. The reaction can also be enhanced by placing screens of wire mesh between adjacent plates to assure that the gas bubbles contacting the catalyst wires are of a small size. Screens that are 40-mesh (U.S. Sieve Series) of either stainless steel or aluminum will serve this purpose.

Product gas is drawn from the head space 14 of the reaction vessel 11 and passed through a supplementary catalyst bed of the same catalyst material as the catalyst grids 25 of the reaction vessel. In the diagram shown, two such supplementary catalyst beds 31, 32 of identical construction and catalyst composition are arranged in parallel. The supplementary catalyst beds can be in the form of metallic wire screens, grids, or perforated plates similar to those of the catalyst grids 25 in the reactor vessel 11. The supplementary catalyst promotes the same reaction that occurs in the reaction vessel 11 for any unreacted materials that have been carried over with the product gas drawn from the reaction vessel. Product gas emerging from the supplementary catalyst beds is passed through a condenser 33, and the resulting condensate 34 is directed to the product vessel 12 where it is introduced under the liquid level in the product vessel.

The liquid level in the product vessel 12 is controlled by a level control 41 that is actuated by a pair of float valves inside the vessel and that governs a motor valve 42 on a liquid product outlet line 43 at the base of the vessel. Above the liquid level is a packed bed 44 of conventional tower packings. Examples are Raschig rings, Pall rings, and Intalox saddles; other examples will be readily apparent to those familiar with distillation towers and column packings. The packing material is inert to the reactants and products of the system, or at least substantially so, and serves to entrap liquid droplets that may be present in the gas phase and return the entrapped liquid back to the bulk liquid in the lower portion of the vessel. Unreacted gas 45 is withdrawn from the head space 46 above the packed bed by a gas pump 47. The pump outlet is passed through a check valve 48 and then directed to the reaction vessel 11 where it enters through the gas distributor 24 positioned between the resistance heater 23 and the catalyst grids 25.

Figure 2:
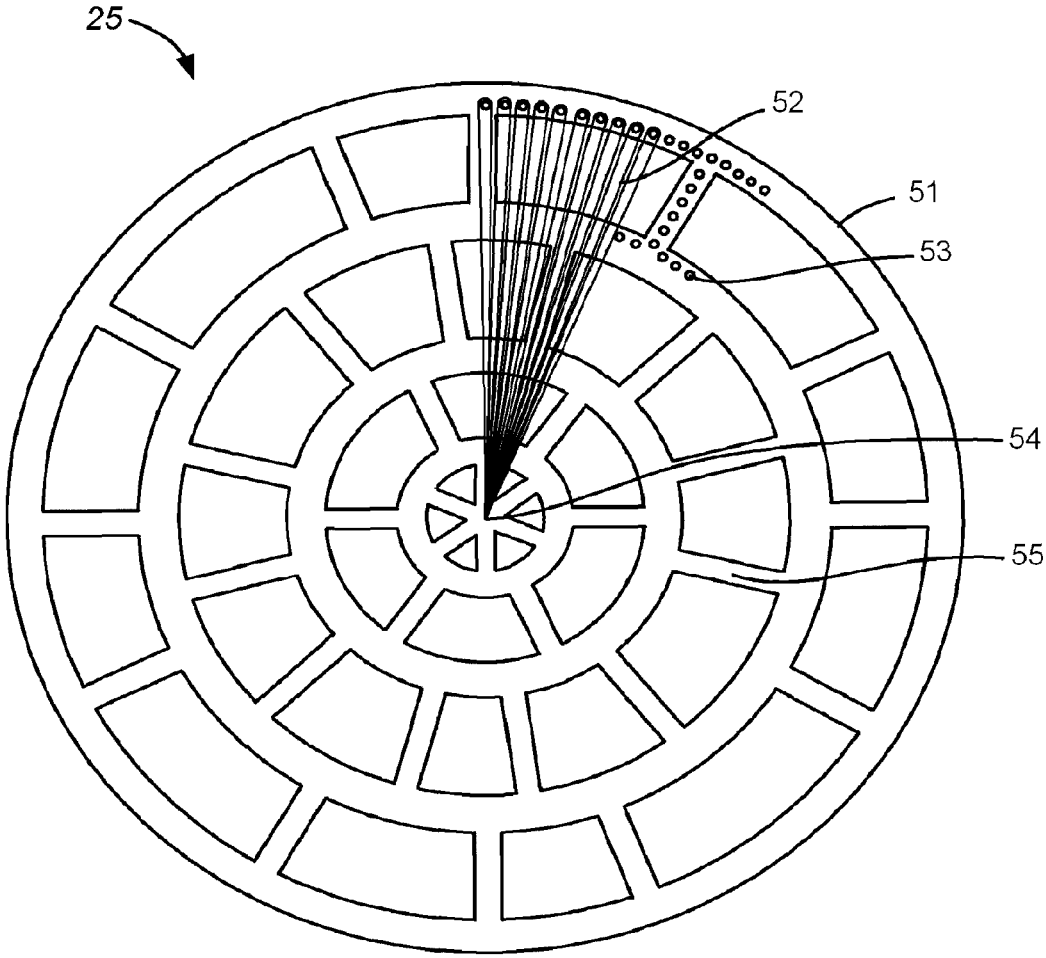
FIG. 2 is a top view of a catalyst grid used in the reactor shown in the process flow diagram of FIG. 1.

FIG. 2 is a top view of one of the catalyst grids 25, showing the frame 51 and only a portion of the windings 52 (in the actual construction, the windings will continue to cover the full circumference of the frame). Also shown are some of the pegs 53 around which the windings are wound. The electric potential discussed above can be measured between the collected windings at the center 54 of the grid and a site 55 on the frame at a distance approximately half the length of the radius from the center.

Alternatives to the units described above and shown in the Figure will be readily apparent to the skilled chemical engineer. Alternatives to the resistance heater, for example, are heating jackets, heating coils using steam or other heat-transfer fluids, and radiation heaters. Heating of the reaction vessel can also be achieved, either in part or in whole, by recirculation of heat transfer fluid between the coolant side of the condenser and the reaction vessel. The gas distributors for the inlet feed and the recycle gas can be any of a variety of types known in the art. Examples are perforated plates, cap-type distributors, and pipe distributors. The liquid level controls can likewise be any of a variety of mechanisms known in the art. Examples are float-actuated devices, devices measuring hydrostatic head, electrically actuated devices such as those differentiating liquid from gas by electrical conductivity or dielectric constant, thermally actuated devices such as those differentiating by thermal conductivity, and sonic devices based on sonic propagation characteristics. The condenser can be replaced by any other known type of condenser. Examples of condensers in general are shell-and-tube condensers and plate-and-frame condensers, and among the shell-and-tube condensers are horizontal tube condensers and vertical tube condensers. Either co-current or counter-current condensers can be used, and the condensers can be air-cooled, water-cooled, or cooled by organic coolant media such as automotive anti-freeze (for example, 50% pre-diluted ethylene glycol) and other glycol-based coolants.

Example 1

This example illustrates the present invention as applied to natural gas as the methane-containing gas and diesel oil as the liquid petroleum fraction. The equipment used was as shown in FIG. 1, in which the reaction vessel was a tank with a volumetric capacity of 1,000 gallons (3,785 liters) and a diameter of 6.5 feet (2 meters). The tank was initially charged with 600 gallons (2,270 liters) of diesel fuel maintained at a temperature of 290° F. (143° C.) and a pressure of 6 psig (143 kPa), and natural gas was bubbled through the reactor at a rate of 20,000 SCFH. The catalyst grids consisted of nickel wire, tungsten wire, cobalt wire (an alloy containing approximately 50% cobalt, 10% nickel, 20% chromium, 15% tungsten, 1.5% manganese, and 2.5% iron), and aluminum wire over a gray iron frame. Once fully started, the reactor produced liquid product at a rate of 200 gallons per hour (760 liters per hour), and two gallons of product for every gallon of reaction medium depleted. All gallons listed herein are U.S. gallons.

The product was analyzed by standard ASTM protocols and the results are listed in Table I.

TABLE I

Product Test Results

| | Protocol | Result | |
|---|---|---|---|
| Flash Point | ASTM D 93 | 64° | C. |
| Sediment and Water | ASTM D2709 | 0.000 | vol % |
| Observed barometric pressure | | 759 | mm Hg |
| Distillation corrected to 760 mm Hg (1 atm) | ASTM D 86 | Percent Recovered: | Result |
| | | Initial b.p. | 179.9° C. |
| | | 5 | 193.8° C. |
| | | 10 | 199.5° C. |
| | | 15 | 203.8° C. |
| | | 20 | 208.0° C. |
| | | 30 | 216.2° C. |
| | | 40 | 223.4° C. |
| | | 50 | 230.5° C. |
| | | 60 | 238.0° C. |
| | | 70 | 246.7° C. |
| | | 80 | 257.3° C. |
| | | 85 | 264.3° C. |
| | | 90 | 272.9° C. |
| | | 95 | 287.8° C. |
| | | End | 296.1° C. |
| | | Recovery | 97.0% |
| Viscosity @ 40° C. | ASTM D 445a-1.8 | 1.83 | $mm^2/s$ |
| Ash | ASTM D 482 | <0.001 | weight % |
| Sulfur by Microcoulometry | ASTM D 3120 | 5 | mg/kg |
| Total Sulfur by UV Fluorescence | ASTM 5453-1.0 | 2.4 | mg/kg |
| Copper Corrosion, 3 hours at 50° C. | ASTM D 130 | 1a | |
| Cetane No. | ASTM D613 | 42.8 | |
| API Gravity at 60° F. | ASTM D287 | 38.2 | Deg. API |
| Aromatics | | 18.1 | volume % |
| Olefins | | 1.6 | volume % |
| Saturates | | 80.3 | volume % |

TABLE I-continued

| Product Test Results | | |
|---|---|---|
| | Protocol | Result |
| Cloud Point | ASTM D2500 | −44° C. |
| Ramsbottom Carbon Residue, 10% Bottoms | ASTM D 524 | 0.06 weight % |
| Lubricity by HFRR at 60° C. | | 2809 μm |
| Total Nitrogen | ASTM D 4629 | 7.7 mg/kg |
| Total Aromatics | ASTM D 5186 | 19.2 weight % |
| Mono-Aromatics | ASTM D 5186 | 18.3 weight % |
| Polynuclear Aromatic Hydrocarbons | ASTM D 5186 | 0.9 weight % |

Electrical measurements were taken between the windings at the center of the frame and the frame at a point midway between the center and the outer edge. At steady state, the measurements at one point in time were those shown in Table II:

TABLE II

| Voltage Generated | | | | | |
|---|---|---|---|---|---|
| | Voltage | Period | Frequency | Rise Time | Fall Time |
| Mean | 1.1160 V | 41.7 msec | 75.1 Hz | 4.8 msec | 4.6 msec |
| Minimum | 110 mV | 16.4 μsec | 2.1 Hz | −20.6 msec | −221.4 μsec |
| Maximum | 4.243 V | 482.7 msec | 61.0 kHz | 461.1 msec | 463.6 msec |

The product was used as fuel in an F-150 Ford pick-up truck for city driving in Reno, Nev., USA, to achieve a mileage of 14 miles/gal. The same pick-up truck normally obtains 10 miles/gal on gasoline. The product was also used as fuel in Mercedes Benz 320S automobile in city driving in Reno, Nev., USA, to achieve mileage of 30 miles/gal. With commercial diesel fuel, the same vehicle obtained 18 miles/gal. The product was also used on a Hummer 1 automobile in city driving in Reno, Nev., USA, to achieve mileage of 12 miles/gal. With commercial diesel fuel, the same vehicle obtained 7 miles/gal.

Example 2

This example provides the results of emissions tests on two test fuels manufactured in accordance with the present invention and compares these results with results obtained on commercially available No. 2 Ultra Low Sulfur Diesel (ULSD) fuel, all tests conducted in heavy-duty on-road diesel engines using the EPA Transient Cycle Heavy-Duty Test Protocol. The two test fuels were manufactured under the same conditions and in the same equipment as that of Example 1, with kerosene as the liquid petroleum faction in the first test fuel and No. 2 ULSD as the liquid petroleum faction in the second test fuel, and natural gas (95% methane) as the methane-containing gas for both.

The heavy duty test engine used in the tests was a 1990 model year Caterpillar diesel engine, Model No. 3406B. The test protocol is one that is currently used for emission testing of heavy-duty on-road engines in the United States, pursuant to 40 CFR §86.1333. The test begins with a cold start after parking overnight, followed by idling, acceleration, and deceleration phases and subjects the engine to a wide variety of speeds and loads sequenced in a computer-controlled automatic engine dynamometer to simulate the running of the vehicle. There are few stabilized running conditions, and the average load factor is about 20% to 25% of the maximum horsepower available at a given speed. The test cycle is twenty minutes in duration and two such cycles are performed, the first from a cold start and the second from a hot start twenty minutes after the end of the first cycle. The equivalent average speed is about 30 km/h and the equivalent distance traveled for each cycle is 10.3 km. Emissions that were continuously measured and recorded every second included total hydrocarbons (THC), methane ($CH_4$), non-methane hydrocarbons (NMHC=THC−$CH_4$), carbon monoxide (CO), carbon dioxide ($CO_2$), oxides of nitrogen ($NO_x$), and nitrous oxide ($NO_2$). Fuel consumption was measured gravimetrically and reported in grams per brake horsepower per hour (g/bhp-hr). Particulate matter (PM) was captured over the entire test cycle on a single filter medium and weighed. A non-dispersive infrared detector was used for measuring CO and $CO_2$, a flame ionization detector was used for measuring THC and $CH_4$, a heated chemiluminescent detector was used for measuring $NO_x$ and NO, and PM was measured by a primary tunnel dilution followed by secondary tunnel dilution in a Model SPC-472 Smart Sampler of AVL Powertrain Engineering, Inc. The raw data were corrected by the computer for temperature, barometric pressure, and humidity, as well as for any hydrocarbons and carbon monoxide present in the dilution air, and expressed as grams per brake horsepower per hour.

The results are shown in Tables III and IV, where the "Baseline" values represent the results obtained with the commercially obtained No. 2 ULSD diesel fuel.

TABLE III

| Emission Test Results - Raw Data | | | | | | | | | |
|---|---|---|---|---|---|---|---|---|---|
| | bhp/hr | | grams | | | | | | g/bhp-hr |
| | HP Demand | HP Actual | THC | NMHC | CO | $NO_x$ | $CO_2$ | Fuel | PM |
| Baseline | 24.37 | 23.01 | 4.20 | 3.94 | 64.5 | 233.4 | 15172.6 | 4371.5 | 0.224 |
| Test Fuel No. 1 | 24.38 | 22.67 | 5.85 | 5.61 | 64.7 | 208.0 | 14902.0 | 4364.0 | 0.243 |

TABLE III-continued

| Emission Test Results - Raw Data | | | | | | | | | |
|---|---|---|---|---|---|---|---|---|---|
| | bhp/hr | | | | | | | | |
| | HP | HP | grams | | | | | | g/bhp-hr |
| | Demand | Actual | THC | NMHC | CO | $NO_x$ | $CO_2$ | Fuel | PM |
| Deviation from Baseline | | −1.5% | 39.3% | 42.4% | 0.3% | −10.9% | −1.8% | −0.2% | 8.5% |
| Test Fuel No. 2 | 24.37 | 22.83 | 4.87 | 4.22 | 66.2 | 215.5 | 14932.5 | 4388.0 | 0.214 |
| Deviation from Baseline | | −0.8% | 16.0% | 7.1% | 2.6% | −7.7% | −1.6% | 0.4% | −4.5% |

TABLE IV

| Emission Test Results - Corrected | | | | | | | | | |
|---|---|---|---|---|---|---|---|---|---|
| | bhp/hr | | | | | | | | |
| | HP | HP | g/bhp-hr | | | | | | |
| | Demand | Actual | THC | NMHC | CO | $NO_x$ | $CO_2$ | Fuel | PM |
| Baseline | 24.37 | 23.01 | 0.18 | 0.17 | 2.81 | 10.15 | 659.46 | 0.4189 | 0.224 |
| Test Fuel No. 1 | 24.38 | 22.67 | 0.26 | 0.25 | 2.86 | 9.18 | 657.41 | 0.4244 | 0.243 |
| Deviation from Baseline | | −1.5% | 44.4% | 47.1% | 1.8% | −9.6% | −0.3% | 1.3% | 8.5% |
| Test Fuel No. 2 | 24.37 | 22.83 | 0.20 | 0.18 | 2.90 | 9.44 | 654.13 | 0.4238 | 0.214 |
| Deviation from Baseline | | −0.8% | 11.1% | 5.9% | 3.2% | −7.0% | −0.8% | 1.2% | −4.5% |

In the claims appended hereto, the terms "a" and "an" are intended to mean "one or more." The term "comprise" and variations thereof such as "comprises" and "comprising," when preceding the recitation of a step or an element, are intended to mean that the addition of further steps or elements is optional and not excluded. All patents, patent applications, and other published reference materials cited in this specification are hereby incorporated herein by reference in their entirety. Any discrepancy between any reference material cited herein and an explicit teaching of this specification is intended to be resolved in favor of the teaching in this specification. This includes any discrepancy between an art-understood definition of a word or phrase and a definition explicitly provided in this specification of the same word or phrase.

What is claimed is:

1. A process for producing a liquid fuel from a gas containing at least about 70% methane by volume, said process comprising:

(a) passing said gas through a metallic catalyst grid immersed in a liquid petroleum fraction in a reaction vessel, with said liquid petroleum fraction at a temperature of about 80° C. or above but below the boiling temperature of said liquid petroleum fraction, said metallic catalyst comprising windings of a transition metal supported on an iron frame, to produce a fluctuating electric potential between said windings and said frame;

(b) collecting a gaseous effluent from said reaction vessel; and (c) condensing said gaseous effluent to said liquid fuel.

2. The process of claim 1 wherein said gas contains at least about 85% methane by volume.

3. The process of claim 1 wherein said gas is natural gas.

4. The process of claim 1 wherein said windings are supported on said frame through pegs of a metal whose electrical resistivity is at least about $15\times10^{-8}$ ohm meters at 100° C.

5. The process of claim 1 wherein said windings are of a plurality of transition metals.

6. The process of claim 1 wherein said metals of said plurality of transition metals are cobalt, nickel and tungsten.

7. The process of claim 1 wherein said catalyst comprises windings of cobalt, nickel, tungsten, and aluminum on an iron frame.

8. The process of claim 1 wherein said liquid petroleum fraction is a member selected from the group consisting of mineral oil, diesel oil, naphtha, kerosene, gas oil, and gasoline.

9. The process of claim 1 wherein said liquid petroleum fraction is a member selected from the group consisting of diesel oil, kerosene, and gasoline.

10. The process of claim 1 wherein said gas is natural gas and said liquid petroleum fraction is diesel oil.

11. The process of claim 1 wherein step (a) is performed at a temperature of from about 100° C. to about 250° C.

12. The process of claim 1 wherein step (a) is performed at a temperature of from about 100° C. to about 150° C. and a pressure of from about 1 atmosphere to about 1.5 atmospheres.

13. The process of claim 1 wherein said fluctuating electric potential has a time-averaged voltage of from about 100 mV to about 10V and a frequency of from about 30 Hz to about 300 Hz.

14. The process of claim 1 wherein said fluctuating electric potential has an time-averaged voltage of from about 300 mV to about 3V and a frequency of from about 30 Hz to about 300 Hz.

* * * * *